United States Patent [19]

Ruger

[11] 4,094,405

[45] June 13, 1978

[54] SALES PACKAGING

[75] Inventor: Walther Ruger, Munich, Germany

[73] Assignee: Refeka Werbemittel GmbH, Munich, Germany

[21] Appl. No.: 685,514

[22] Filed: May 12, 1976

[51] Int. Cl.[2] ..... B65D 85/50

[52] U.S. Cl. ..... 206/423; 206/472

[58] Field of Search ..... 206/423, 395, 396, 472; 229/34 HW, DIG. 6; 150/44

[56] References Cited

U.S. PATENT DOCUMENTS

| | | | |
|---|---|---|---|
| 527,202 | 10/1894 | Heywood et al. | 150/44 |
| 2,101,355 | 12/1937 | Wonder | 206/396 |
| 2,824,641 | 2/1958 | Koenig | 206/396 |

FOREIGN PATENT DOCUMENTS

| | | | |
|---|---|---|---|
| 1,035,393 | 4/1953 | France | 206/396 |
| 796,601 | 4/1936 | France | 150/44 |

*Primary Examiner*—Herbert F. Ross

[57] ABSTRACT

A rigid container designed to protect fragile material which requires contact with the air, including a base member having air permeable compartments attached thereto, a cover wall ring supported by end walls with the ring having an opening defining the area containing the compartments and a hingeable cover attached to the package with the package designed so that when the hingeable cover is closed there are means for air passage from the outside environment into the individual compartments.

11 Claims, 5 Drawing Figures

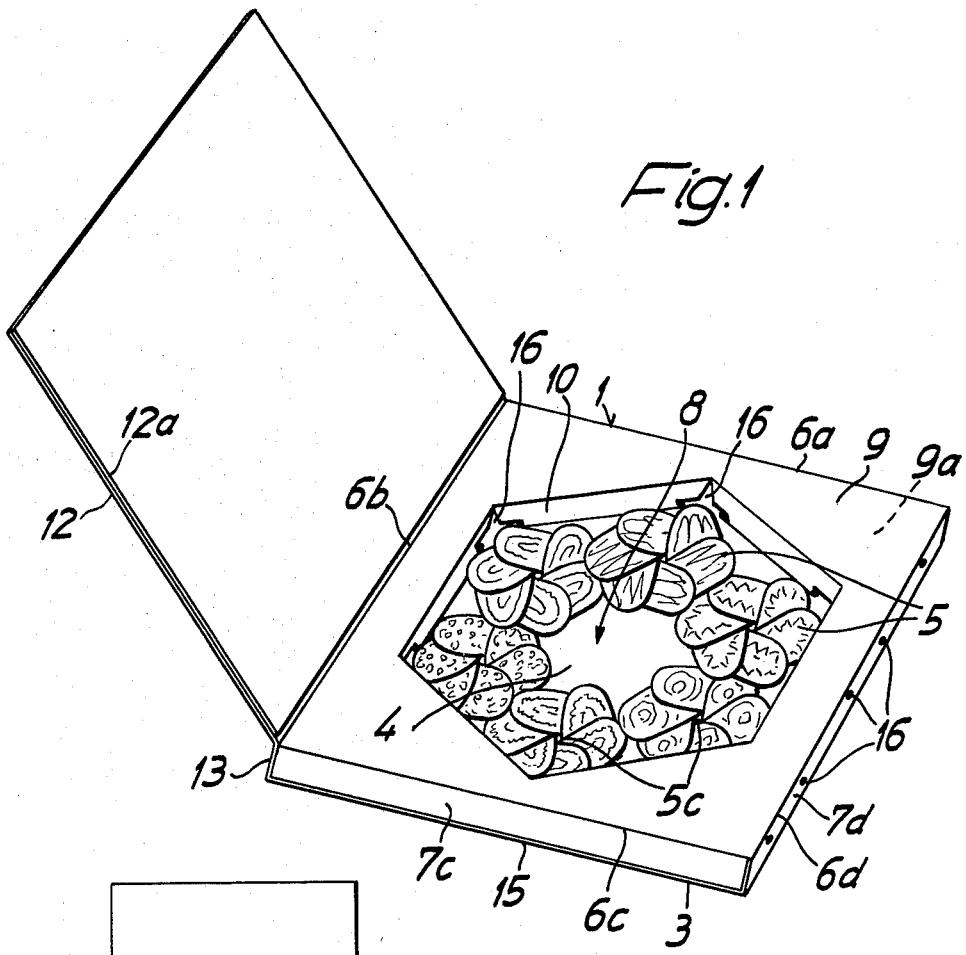
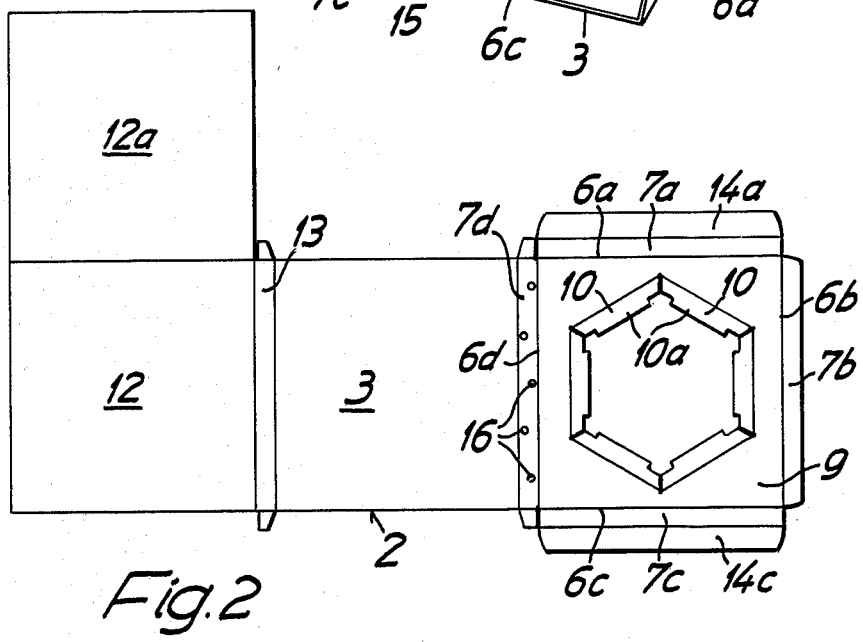
Fig.2

SALES PACKAGING

This invention relates to a container of cardboard or similar material for the reception in common of several folding boxes for objects sensitive to pressure and requiring the access of air, especially for flower seeds or flower bulbs.

In the packing of flower seeds and flower bulbs or of other fragile objects requiring access of air, a container having two opposed requirements of sufficient strength with respect to the transport stresses and sufficient possibility of access for outside air to the objects, is needed. Sales packages hitherto known for seeds or flower bulbs, in which folding boxes receiving of various types were "blistered" in common onto a cardboard plate, are unsatisfactory above all because of difficulties in ventilation.

The basis of this invention is the improvement of the sales package mentioned at the outset in such a way that both the above-mentioned requirements are optimally fulfilled with a container which is easily manufactured.

The problem presented is solved, according to this invention, by providing folding compartments which are attached at their bottoms to a base plate of a flat slab-shaped sales container of cardboard material or the like. The base plate has side walls, the upper edges of which are connected to a cover wall ring surrounding a folding compartment zone. The inner edges of the cover wall ring have supporting walls leading to the base plate, circumscribing the folding compartment zone. Attached to the upper edge of one side wall is a cover foldable onto the cover wall ring. Both the closed folding compartments and the closed container have passage openings allowing a ventilation from outside extending into the folding boxes.

In such a construction of the sales package the individual folding boxes can be constructed without external pressure strains and can be made of cheap thin cardboard paper cutouts, whereas the formation of the sales container with a cover wall ring and side walls depending therefrom yields an optimal pressure stability of the container even if for its production there is used a correspondingly thin and inexpensive cardboard material.

According to a preferred embodiment of the invention, the sales container consists of a foldable cardboard cutout forming a bottom wall, and a base plate, which along the lower edges of the supporting walls of the assembled box has a slit for receiving a tab formed at the bottom of the walls. The base plate, according to a further embodiment of the invention, consists of a corrugated cardboard having mounted on its upper side a sheet of cardboard. This configuration is doubly advantageous, i.e., reinforcement of the bottom of the packing container is obtained, allows the container to be made of a correspondingly thinner and less expensive cardboard material and, on the other hand, the deep slits corresponding to the thickness of the base plate, can be formed which assure a secure anchoring of the tabs inserted in them of the supporting walls.

According to one embodiment of the invention, it is preferred if at least a part of the passage openings consist of slit openings formed in walls of the sales container not connected with each other. Through the elimination of special connecting strips otherwise usual between adjacent walls of boxes or similar packages, a welcome simplification of the sales package results.

The subject invention can be readily understood with reference to the drawings in which:

FIG. 1 shows the sales package in a perspective view obliquely from above;

FIG. 2 shows a cardboard cutout of a container receiving several folding compartments of the sales package according to FIG. 1, in a plan view;

Figure 3:
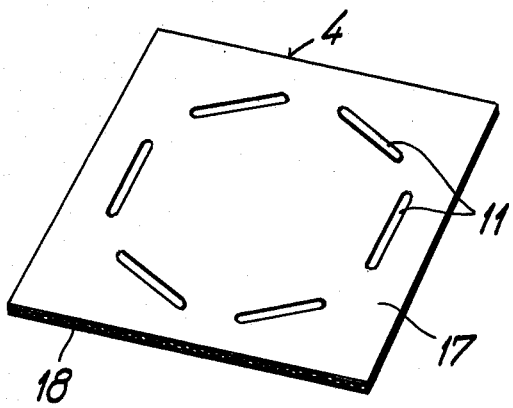
FIG. 3 shows a base plate serving to reinforce the bottom wall of the sales container according to FIG. 2, in a view corresponding to FIG. 1.

The container represented in FIG. 1 is foldable out of a cardboard cutout 2 (FIG. 2) and is reinforced by a base plate 4 (FIG. 3) settable on its base wall 3, as well as fold rosettes 5 glued onto the middle zone of the base plate 4 above, each of which is intended to receive expediently different types of flower seeds (not represented.) While the folding rosettes 5 can consist of an easily foldable thin cardboard paper, somewhat stronger, but likewise still easily workable cardboard material is preferred for the sales container, which would not result in a sufficiently pressure-proof sales container.

According to FIG. 1 the sales container 1 has upper edges 6*a*, 6*b*, 6*c* and 6*d* attached to a cover ring 9 and defining the periphery thereof. Side walls 7*a*, 7*b*, 7*c* and 7*d* extend perpendicularly downward from respective upper edges. A folding compartment zone 8 defined by an opening in ring 9 from the inner edge of which there depend supporting walls 10 directed perpendicularly downward to the base plate 4. The supporting walls 10 have on their outer edges in each instance, a tab 10*a*, with which they engage, in the folded container 1 according to FIG. 1, an allocated slit 11 of the base plate 4 (cf. FIG. 3) and thereby can be securely locked in their perpendicular position.

Figure 4:
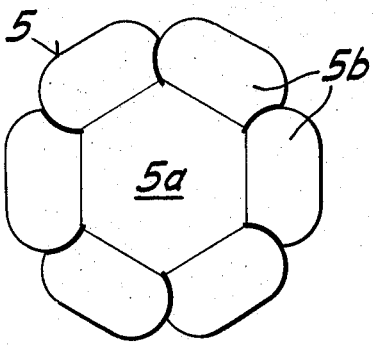
FIG. 4 shows the cutout of a folding compartment designed as a folding rosette for flower seeds, in a plan view.

The folding rosette compartment 5, as shown in FIG. 4, includes a hexagonal base 5*a*, having cover wall parts 5*b* extending outwardly from the sides thereof. The wall parts 5*b* are oval-shaped, each one of them having an arcuate notch, located at the lower right end thereof, adjacent to the base.

When the folding rosette 5 is spread out horizontally in a flat open position relative to the base, the wall parts will not overlap one another due to the aforementioned notches.

As seen in FIG. 1, the wall parts 5*b* are adapted to be folded overlappingly from their hexagonal base 5*a*, forming a cover for the base and defining a central slit-form access opening 5*c* for the outside air, in fan-form configuration.

The folding rosettes 5, have, therefore, sufficient access to the outside air due to the openings 5*c*. Also, in the case of the closed sales container 1, there is yielded an adequate possibility of access for the outer air to the folded compartment zone 8 through cover 12 which can be folded open only flatly on the outside of the cover wall ring 9. Only a single fluing is needed at the inside of the cover 12 on the engagement place of the side wall 7*b* which serves also as a gluing strip, along with a further side wall 13 of the cardboard cutout 2 situated between the bottom wall 3 and the cover 12, to which it is glued. Tab 12*a* may be glued to cover 12, if desired. In particular, insert strips 14*a* and 14*c* connecting to the outer edges of the side walls 7a and 7c are thrust in the folded sales container 1 over the bottom wall 3, so that on the finished container 1 between the bottom wall 3 and the side walls 7a and 7c underneath the insert strips 14a and 14c gaps 15 remain for access of air into the annular space 9a underneath the cover wall ring 9. There are also connecting openings 16 formed between the supporting walls 10. For further improvement of the ventilation of the annular space 9a, at least one side wall can have additional ventilation openings 16, as is illustrated, for example, on the side wall 7d.

From FIG. 3 it is evident that the bottom plate 4 consists of a corrugated cardboard 18 coated on its upper side with a sheet of cardboard 17. The bottom plate 4 contributes not only to an advantageous reinforcement of the bottom wall 3, but the greater wall thickness and strength resulting leads to correspondingly deep slits 11, in which there is a dependable locking of the tabs 10a of the supporting walls 10 may be accomplished.

The otherwise usual formation of the cardboard cutout 2 with the crease lines connecting and individual wall parts of the sales container 1, are shown, for example, also in the place of the upper edges 6a, 6b, 6c and 6d of the side walls 7a, 7b, 7c and 7d is to be seen sufficiently well from FIG. 2 and, therefore, requires no detailed description.

Figure 5:
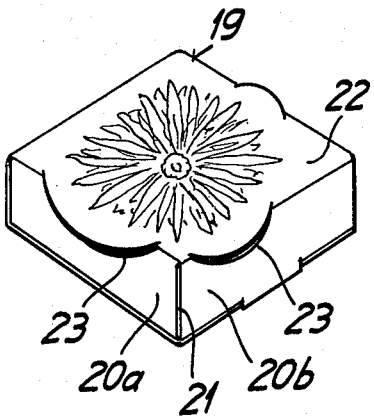
FIG. 5 shows another embodiment of a folding compartment intended for the reception of flower bulbs in a flat slab form in a view corresponding to FIG. 1.

As shown in FIG. 5, instead of the folding rosettes 5, there could be glued to the bottom wall 3 of the sales container 1 also larger folding boxes 19 suited, for example, for the reception of flower bulbs. The folding box 19 is folded otherwise, likewise from a usual box cutout (not represented in detail) has a shallow slab form and forms ventilation slits 21 along the side edges situated between its side walls 20a and 20b. Through a corresponding precreasing of the cover wall 22 on the box cut-out the folding boxes 19 additional ventilation openings 23 in the side walls 20a and 20b can be formed.

Although for reasons of folding technique, a polygonal inner edge of the cover wall ring 9 offers itself, a form other than the hexagonal form represented is possible. In particular, in the case of a reception of slab-form folding boxes 19 there is recommended for the reaction of a larger folding box zone 8 the choice of a polygon have still more corners for the inner edge of the cover wall ring 9. So that the side wall 7d consisting only of simple cardboard material is not weakened, it can, further, be advantageous to provide such ventilation holes in the place of the double wall formed at the two side walls 7b and 13. If for the package represented, for ease of manufacturing, the simple cardboard and cardboard paper material is preferred, it nevertheless lies within the scope of the invention, especially in the case of relatively large sales packages, to use cardboard or pasteboard material improved in a usual manner, for example, coated also with plastic. Finally, the cardboard cutout 2 can be made differently than represented and the folding boxes 19 could be executed differently, for example, without the ventilation openings 23.

What is claimed is:

1. A rigid container having foldable portions, said container designed to protect fragile contents while allowing said contents access to air comprising:

a. a base;

b. compartments mounted essentially on said base defining a folding compartment zone, each compartment foldable about its contents in a manner which allows the contents access to air;

c. a cover wall ring surrounding the folding compartment zone having an opening defining the area of said zone, said cover wall ring having outer edges defining the outer periphery thereof, and inner edges defining the opening thereof;

d. outer side walls extending downwardly from said outer edges, respectively, for supporting and elevating said cover wall ring in spaced relationship to said base; and e. a cover hingable on said cover wall ring, said container having air passage means operable when the cover is in the closed position for passage of air between the compartment zone and the area exterior to the container.

2. The container of claim 1, in which said ring is further supported by inner supporting walls depending from said inner edges thereof, and engaging the base.

3. The container of claim 2, in which the inner supporting walls are interlocked into the base.

4. The container of claim 2, in which a base plate is mounted on top of the base and the inner supporting walls are attached thereto, said base plate having the same dimensions as the base.

5. The container of claim 1 in which the compartments are folding rosettes which when closed allow for the passage of air.

6. The container of claim 1 in which the compartments are individual boxes having air passage means located at portions of the periphery of the side walls.

7. The container of claim 1 in which the air passage means include orifices located in at least one of the side walls.

8. The container of claim 1 in which air passage means include passageways at the periphery of at least one of the side walls.

9. The container of claim 1 in which the air passage means include an open area between at least two of said supporting walls.

10. The container of claim 2 in which said base is corrugated cardboard and said base has a base plate having slits for engagement of said supporting walls mounted thereupon.

11. The container of claim 1, in which said compartment is a folding rosette, comprising a polygonal base having oval-shaped wall members extending outwardly therefrom, said wall members foldable about said base to form a cover therefor, the cover having a slit-form air access opening centrally defined therein, and said wall members each having an arcuate notch at the lower right end thereof so that when said wall members are in a horizontal open position relative to said base, they do not overlap each other.

* * * * *

UNITED STATES PATENT OFFICE

CERTIFICATE OF CORRECTION

PATENT NO. : 4,094,405

DATED : June 13, 1978

INVENTOR(S) : WALTHER RUGER

It is certified that error appears in the above-identified patent and that said Letters Patent are hereby corrected as shown below:

The following should be included on the Cover Sheet;

--[30] Foreign Application Priority Date:

November 11, 1975 Germany 75 35856 ---.

Signed and Sealed this

*Second* Day of *January 1979*

[SEAL]

*Attest:*

RUTH C. MASON
*Attesting Officer*

DONALD W. BANNER
*Commissioner of Patents and Trademarks*